US009311872B2

(12) United States Patent
Takahashi et al.

(10) Patent No.: US 9,311,872 B2
(45) Date of Patent: Apr. 12, 2016

(54) DISPLAY DEVICE WITH TIMING CONTROLLER

(75) Inventors: Kohzoh Takahashi, Osaka (JP); Kohji Saitoh, Osaka (JP); Akizumi Fujioka, Osaka (JP); Jun Nakata, Osaka (JP); Toshihiro Yanagi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 80 days.

(21) Appl. No.: 14/237,970

(22) PCT Filed: Aug. 7, 2012

(86) PCT No.: PCT/JP2012/070122

§ 371 (c)(1),
(2), (4) Date: Feb. 10, 2014

(87) PCT Pub. No.: WO2013/024754

PCT Pub. Date: Feb. 21, 2013

(65) Prior Publication Data

US 2014/0225881 A1 Aug. 14, 2014

(30) Foreign Application Priority Data

Aug. 12, 2011 (JP) ..... 2011-177221
Dec. 21, 2011 (JP) ..... 2011-280500

(51) Int. Cl.
*G09G 5/00* (2006.01)
*G09G 3/36* (2006.01)

(52) U.S. Cl.
CPC ..... *G09G 3/3614* (2013.01); *G09G 2320/0209* (2013.01); *G09G 2330/021* (2013.01); *G09G 2340/0435* (2013.01)

(58) Field of Classification Search
CPC ..... G06F 3/038; G09G 5/00; G09G 3/30; G09G 3/36; G09G 3/10; G06M 3/00; G06M 7/00; G06M 11/00; G06M 3/02; G06M 9/00; G11C 19/00
USPC ..... 345/204, 208, 209
See application file for complete search history.

(56) References Cited

U.S. PATENT DOCUMENTS 5,712,652 A 1/1998 Sato et al.
2002/0180673 A1 12/2002 Tsuda et al.
2004/0169632 A1 9/2004 Hosaka et al.

(Continued)

FOREIGN PATENT DOCUMENTS

CN 1520681 A 8/2004
CN 1540395 A 10/2004

(Continued)

OTHER PUBLICATIONS

Takahashi et al.; "Display Device, Drive and Method Thereof, and Electronic Device"; U.S. Appl. No. 14/327,665, filed Jul. 10, 2014.

(Continued)

*Primary Examiner* — Pegeman Karimi
(74) *Attorney, Agent, or Firm* — Keating & Bennett, LLP

(57) ABSTRACT

A display device (1) includes (i) refresh rate changing means (15) for changing a refresh rate of a display panel (2) and (ii) a polarity reversal controlling section (20) for changing, in accordance with a change in the refresh rate, at least one of a temporal cycle and a spatial cycle of a polarity reversal of a source signal.

9 Claims, 15 Drawing Sheets

(56) References Cited

U.S. PATENT DOCUMENTS

| | | | | |
|---|---|---|---|---|
| 2004/0207756 | A1 | 10/2004 | Fujii et al. | |
| 2004/0212609 | A1 | 10/2004 | Igarashi | |
| 2004/0233135 | A1 | 11/2004 | Kim et al. | |
| 2004/0252115 | A1* | 12/2004 | Boireau | 345/211 |
| 2007/0126697 | A1 | 6/2007 | Sato et al. | |
| 2008/0079701 | A1* | 4/2008 | Shin et al. | 345/204 |
| 2008/0291326 | A1* | 11/2008 | Shishido et al. | 348/555 |
| 2008/0297500 | A1 | 12/2008 | Kato | |
| 2009/0141332 | A1 | 6/2009 | Futatsuya et al. | |
| 2010/0033456 | A1 | 2/2010 | Yoshida et al. | |
| 2011/0001747 | A1 | 1/2011 | Shimizu et al. | |
| 2011/0128303 | A1 | 6/2011 | Yonemaru et al. | |
| 2011/0134154 | A1 | 6/2011 | Miyachi et al. | |
| 2012/0012835 | A1* | 1/2012 | Herman et al. | 257/43 |
| 2012/0320009 | A1* | 12/2012 | Liu | 345/204 |

FOREIGN PATENT DOCUMENTS

| | | | |
|---|---|---|---|
| CN | 1306322 | C | 3/2007 |
| CN | 100446063 | C | 12/2008 |
| JP | 05-61440 | A | 3/1993 |
| JP | 08-286170 | A | 11/1996 |
| JP | 2000-347762 | A | 12/2000 |
| JP | 2001-312253 | A | 11/2001 |
| JP | 2002-229524 | A | 8/2002 |
| JP | 2004-151222 | A | 5/2004 |
| JP | 2007-72243 | A | 3/2007 |
| JP | 2007-179000 | A | 7/2007 |
| JP | 2008-233925 | A | 10/2008 |
| JP | 2008-298997 | A | 12/2008 |
| JP | 2009-3420 | A | 1/2009 |
| JP | 2009-42664 | A | 2/2009 |
| JP | 2009-134211 | A | 6/2009 |
| JP | 2011-009701 | A | 1/2011 |

OTHER PUBLICATIONS

Official Communication issued in International Patent Application No. PCT/JP2012/070122, mailed on Sep. 11, 2012.

Takahashi et al., "Display Device, Drive Method Thereof, and Electronic Device", U.S. Appl. No. 14/000,655, filed Aug. 21, 2013.

Official Communication issued in International Patent Application No. PCT/JP2012/059118, mailed on Jul. 10, 2012.

* cited by examiner

FIG. 13

| | 120Hz | 60Hz | 50Hz | 40Hz | 35Hz | 30Hz | 20Hz |
|---|---|---|---|---|---|---|---|
| dot reversal | ◎ | ◎ | ◎ | ◎ | ◎ | ○ | △ |
| two-dot reversal | ◎ | ◎ | ◎ | ◎ | ○ | △ | × |
| eight-dot reversal | ◎ | ◎ | ◎ | ◎ | ○ | △ | × |
| source reversal | ◎ | ◎ | ◎ | ◎ | ○ | △ | × |

◎ : no flicker is recognized
○ : flicker is recognized but does not bring any annoyance
△ : flicker is annoying
× : flicker is so annoying that an image cannot be recognized

FIG. 14

(a)

source reversal

| frequency (Hz) | 60 | 30 | 20 | 1 |
|---|---|---|---|---|
| electric current (mA) | 126.6 | 93.9 | 81.9 | 59.3 |
| electric power (mW) | 417.78 | 309.87 | 270.27 | 195.69 |

(b)

2H dot reversal

| frequency (Hz) | 60 | 30 | 20 | 1 |
|---|---|---|---|---|
| electric current (mA) | 191.7 | 126.3 | 103.9 | 60.3 |
| electric power (mW) | 632.61 | 416.79 | 342.87 | 198.99 |

DISPLAY DEVICE WITH TIMING CONTROLLER

TECHNICAL FIELD

The present invention relates to a display device.

BACKGROUND ART

Recently, thin, lightweight, and low-power consumption display devices, as typified in liquid crystal display devices, have been in widespread use. Such a display device is often for use in, for example, a mobile phone, a smart phone, a PDA (Personal Data Assistance), an electronic book, or a laptop personal computer. Furthermore, it has been expected that electronic papers will be rapidly developed and come into widespread use as thinner display devices in the future. Under such circumstances, such various display devices have been required to reduce power consumption and improve display quality.

Various techniques for reducing power consumption and improving display quality of such display devices have been devised.

For example, Patent Literature 1 discloses a technique of varying reversal intervals of display data from one frame to another frame so as to prevent crosstalk in a liquid crystal display device in which a polarity of the display data is reversed for each pixel row.

CITATION LIST

Patent Literature

Patent Literature 1

Japanese Patent Application Publication, Tokukaihei, No. 05-061440 A (Publication Date: Mar. 12, 1993)

SUMMARY OF INVENTION

Technical Problem

Conventionally, a technique of increasing the number of frames per unit time is employed so as to display a higher-definition image. For example, by increasing the number of frames per one (1) second from 60 to 120 (that is, from 60 fps to 120 fps), it is possible to (i) display a moving image which more smoothly moves, and (ii) prevent a display defect such as flicker. Such an increase in the number of frames per unit time, however, causes an increase in the number of driving of a display panel. This leads to an increase in power consumption. On the other hand, a technique of decreasing the number of frames per unit time is employed so as to reduce power consumption. However, such a decrease in the number of frames per unit time, as a matter of course, easily causes a display defect such as flicker. As such, according to such conventional techniques, it is not possible to suppress a deterioration in display quality and to reduce power consumption.

The present invention was made in view of the problems, and an object of the present invention is to provide a display device capable of displaying a higher-definition image with lower power consumption.

Solution to Problem

In order to attain the object, a display device of the present invention is configured to include: a display panel which includes (i) a plurality of gate signal lines, (ii) a plurality of source signal lines provided so as to intersect the plurality of gate signal lines, and (iii) a plurality of pixels provided so as to correspond to respective intersections of the plurality of gate signal lines and the plurality of source signal lines; a signal line driving circuit for supplying a source signal to each of the plurality of pixels via a corresponding one of the plurality of source signal lines; refresh rate changing means for changing a refresh rate of the display panel; and polarity reversal controlling means for changing, in accordance with a change in the refresh rate, at least one of a temporal cycle and a spatial cycle of a polarity reversal of the source signal.

According to the display device of the present invention, even in a case where a reduction in power consumption and a deterioration in display quality are caused by the change in refresh rate, the deterioration in the display quality can be suppressed by changing the temporal cycle or the spatial cycle. Furthermore, according to the display device of the present invention, even in a case where an improvement in the display quality and an increase in the power consumption are caused by the change in refresh rate, the increase in the power consumption can be suppressed by changing the temporal cycle or the spatial cycle. Therefore, according to the display device of the present invention, it is possible to reduce the power consumption and suppress the deterioration in the display quality.

Advantageous Effects of Invention

According to a display device of the present invention, it is possible to suppress a deterioration in display quality and a reduction in power consumption, which are caused by a change in refresh rate. This brings about an effect of attaining a higher display quality with a lower power consumption.

BRIEF DESCRIPTION OF DRAWINGS

FIG. 13 is a table showing results of an experiment, made with respect to a display device, as to whether or not flicker is recognized.

FIG. 14 is a table illustrating a power consumption characteristic of a display device.

DESCRIPTION OF EMBODIMENTS

Figure 1:
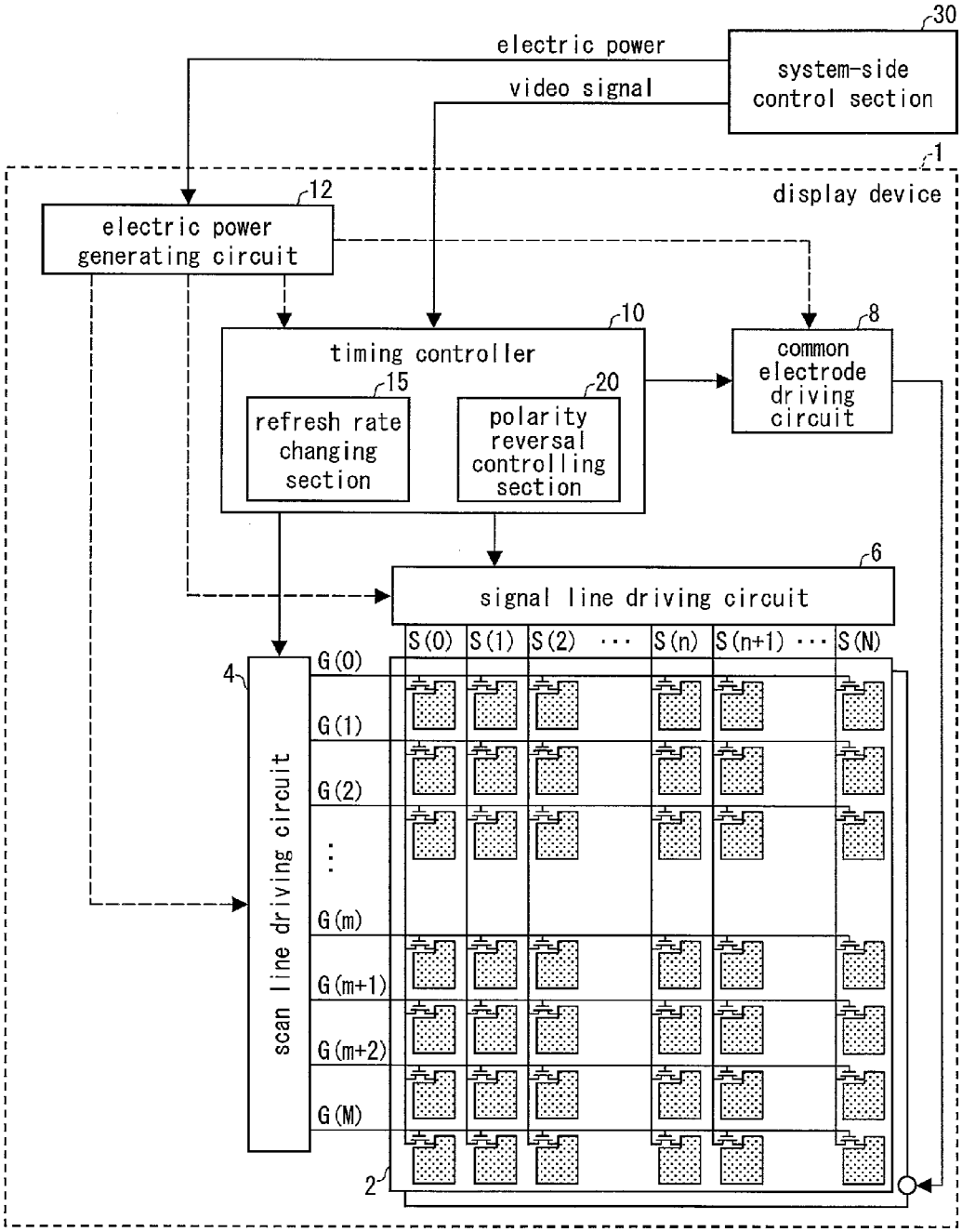
FIG. 1 is a view illustrating an overall configuration of a display device of Embodiment 1.

The following description will discuss embodiments of the present invention with reference to the drawings.

(Embodiment 1)

Embodiment 1 of the present invention will be described below with reference to FIGS. 1 and 2.

(Configuration of Display Device)

An example configuration of a display device 1 of Embodiment 1 will be described below with reference to FIG. 1. FIG. 1 is a view illustrating an overall configuration of the display device 1 of Embodiment 1. As illustrated in FIG. 1, the display device 1 includes a display panel 2, a scan line driving circuit 4, a signal line driving circuit 6, a common electrode driving circuit 8, a timing controller 10, and an electric power generating circuit 12.

According to Embodiment 1, an active matrix liquid crystal display device is employed as the display device 1. Therefore, the display panel 2 of Embodiment 1 is an active matrix liquid crystal display panel and the above-described other components are provided for driving the active matrix liquid crystal display panel.

(Display Panel)

The display panel 2 includes a plurality of pixels, a plurality of gate signal lines G, and a plurality of source signal lines S.

The plurality of pixels are arranged so as to form a plurality of pixel columns and a plurality of pixel rows. That is, the plurality of pixels are arranged in a so-called lattice manner.

The plurality of gate signal lines G are provided in parallel with one another in a pixel column direction (in a direction along the plurality of pixel columns). Each of the plurality of gate signal lines G is electrically connected to pixels which are arranged along a corresponding one of the plurality of pixel rows.

The plurality of source signal lines S are provided (i) in parallel with one another in a pixel row direction (a direction along the plurality of pixel rows) and (ii) orthogonally to the plurality of gate signal lines G. Each of the plurality of source signal lines S is electrically connected to pixels which are arranged along a corresponding one of the plurality of pixel columns.

In the display panel 2 illustrated in FIG. 1, the plurality of pixels are arranged in N columns and in M rows. N source signal lines S are therefore provided for respective N pixel columns, and M gate signal lines G are provided for respective M pixel rows.

(Scan Line Driving Circuit)

The scan line driving circuit 4 selects and scans in sequence each of the plurality of gate signal lines G. Specifically, the scan line driving circuit 4 selects in sequence the plurality of gate signal lines G so as to supply, to the each of the plurality of gate signal lines G, an ON voltage. The ON voltage causes switching elements (TFTs) of respective pixels, which are arranged along the each of the plurality of gate signal lines G, to be turned on.

(Signal Line Driving Circuit)

While the scan line driving circuit 4 is selecting a gate signal line G, the signal line driving circuit 6 supplies, in accordance with image data, source signals to respective pixels via respective source signal lines S, which pixels are arranged along the gate signal line G thus selected. Specifically, the signal line driving circuit 6 (i) calculates, on the basis of a supplied video signal, voltages to be supplied to the respective pixels which are arranged along the gate signal line G thus selected and (ii) supplies the voltages to the pixels via the respective source signal lines S from a source output amplifier. The source signals are supplied to and written in the respective pixels which are arranged along the gate signal line G thus selected.

(Common Electrode Driving Circuit)

The common electrode driving circuit 8 supplies, to a common electrode provided for the plurality of pixels, a predetermined common voltage for driving the common electrode.

(Timing Controller)

The timing controller 10 receives a video signal from outside (a system-side control section 30 in an example illustrated in FIG. 1). According to Embodiment 1, the video signal contains a clock signal, a synchronization signal, and an image data signal. The timing controller 10 supplies, to the scan line driving circuit 4, the signal line driving circuit 6 and the common electrode driving circuit 8, respective control signals which cause the scan line driving circuit 4, the signal line driving circuit 6, and the common electrode driving circuit 8 to operate in synchronization with one another (see solid arrows in FIG. 1).

Specifically, the timing controller 10 supplies, to the scan line driving circuit 4, a gate start pulse signal, a gate clock signal GCK, and a gate output control signal GOE. Upon reception of the gate start pulse signal, the scan line driving circuit 4 starts scanning the plurality of gate signal lines G, sequentially. In synchronization with the gate clock signal GCK and in accordance with the gate output control signal GOE, the scan line driving circuit 4 supplies in sequence an ON voltage to each of the plurality of gate signal lines G.

The timing controller 10 supplies, to the signal line driving circuit 6, a source start pulse signal, a source latch strobe signal, and a source clock signal. In response to the source start pulse signal, the signal line driving circuit 6 causes a register to store therein supplied image data for each of the pixels in synchronization with the source clock signal. Then, in synchronization with a next source latch strobe signal, the signal line driving circuit 6 supplies source signals for the image data to the respective plurality of source signal lines S.

(Electric Power Generating Circuit)

The electric power generating circuit 12 generates, on the basis of electric power supplied from outside (the system-side control section 30 in the example illustrated in FIG. 1), voltages required for the scan line driving circuit 4, the signal line driving circuit 6, and the common electrode driving circuit 8. The electric power generating circuit 12 supplies the voltages to the scan line driving circuit 4, the signal line driving circuit 6, and the common electrode driving circuit 8 (see dashed arrows in FIG. 1).

(Other Functions of Display Device)

The display device 1 of Embodiment 1 further includes a refresh rate changing section 15 and a polarity reversal controlling section 20. According to the example illustrated in FIG. 1, the refresh rate changing section 15 and the polarity reversal controlling section 20 are provided, in the display device 1, so as to carry out one of functions of the timing controller 10.

(Refresh Rate Changing Section 15)

The refresh rate changing section 15 changes a refresh rate of the display panel 2. What is meant by a "refresh rate" is how often display on the display panel 2 is rewritten. For example, in a case where the refresh rate is set to "60 Hz", the display on the display panel 2 is rewritten 60 times per second (that is, the display panel 2 displays data corresponding to 60 frames for one (1) second). In a case where the refresh rate is set to "120 Hz", the display on the display panel 2 is rewritten 120 times per second (that is, the display panel 2 displays data corresponding to 120 frames for one (1) second).

Generally, as a refresh rate becomes higher, display on a display panel is rewritten more frequently, though image quality of data to be displayed becomes higher. Such a more frequent rewriting of the display on the display panel causes an increase in power consumption. Therefore, the refresh rate is sometimes set to a higher frequency, in a case where the image quality of data to be displayed is prioritized, such as a case where a moving image is displayed or a case where a high-definition mode is selected. On the other hand, the refresh rate is sometimes set to a lower frequency, in a case where low power consumption should be prioritized, such as a case where a static image is displayed or a case where a low power consumption mode is selected.

(i) Timing at which the refresh rate changing section 15 changes a refresh rate and (ii) a refresh rate to which the refresh rate changing section 15 changes a current refresh rate, are determined by, for example, an external section such as the system-side control section 30. Specifically, the above (i) and (ii) are determined by the refresh rate changing section 15 in accordance with a control signal received from the external section.

For example, during a vertical blanking period of time by which a first display period of time is followed, the external section transmits to the display device 1 a control signal for controlling the refresh rate changing section 15 to change a current refresh rate to another refresh rate which is to be set in a second display period of time by which the vertical blanking period of time is followed. This allows the display device 1 to start, at a changed refresh rate, carrying out display which is to be carried out during the second display period of time, without any delay.

In accordance with the change in refresh rate of the display panel 2, the sections of the display device 1 drive the display panel 2 so that the display panel 2 carries out a display operation at the changed refresh rate, in response to control signals supplied from the timing controller 10.

In a case where the display device 1 displays a video image such as a moving image which corresponds to a plurality of frames, the display device 1 displays images of frames corresponding to the changed refresh rate.

In a case where the display device 1 includes a frame memory, images of frames corresponding to a changed refresh rate are extracted from images of a plurality of frames stored in the frame memory, and then the display device 1 displays the images thus extracted.

For example, in a case where the display device 1 displays, at a refresh rate "30 Hz," an image corresponding to 60 frames, images of 30 frames of the 60 frames are extracted from the frame memory, and then the display device 1 displays the images thus extracted.

In a case where the display device 1 includes no frame memory, for example, every time the display device 1 receives an image corresponding to one (1) frame from outside, the display device 1 decides in accordance with a changed refresh rate whether or not the display device 1 displays the image, and then the display device 1 displays the image when the display device 1 has decided to display the image.

Alternatively, frames corresponding to a changed refresh rate can be transmitted from an external section at timing at which a refresh rate is changed. This eliminates the necessity that the display device 1 carries out the above controlling operations. That is, the external section can change, in accordance with the changed refresh rate, a clock frequency of a video signal to be transmitted to the display device 1.

(Polarity Reversal Controlling Section 20)

In accordance with such a change in refresh rate of the display panel 2, the polarity reversal controlling section 20 changes a temporal cycle and/or a spatial cycle on which a polarity is reversed with respect to a source signal to be written in each of the plurality of pixels in the display panel 2.

As has been described, the signal line driving circuit 6 writes a source signal in each of the plurality of pixels. Specifically, the signal line driving circuit 6 is configured to reverse a polarity of each source signal and supply, to a corresponding one of the plurality of pixels, a corresponding source signal whose polarity is reversed.

The signal line driving circuit 6 can employ various polarity reversal methods of reversing a polarity of a source signal. Examples of the various polarity reversal methods include (i) a plurality of polarity reversal methods which are different from each other in temporal cycle of a polarity reversal of a source signal and (ii) a plurality of polarity reversal methods which are different from each other in spatial cycle of a polarity reversal of a source signal.

In accordance with the change in refresh rate of the display panel 2, the polarity reversal controlling section 20 changes, to one of the various polarity reversal methods, a polarity reversal method which is currently employed by the signal line driving circuit 6. The polarity reversal controlling section 20 can thus change the temporal cycle and/or the spatial cycle.

What is meant by "a temporal cycle of a polarity reversal of a source signal" is every how many frames a polarity of each of the plurality of pixels included in the display panel 2 is reversed.

For example, in a case where the temporal cycle is set to "every two frames", (i) a state in which a positive source signal is written in each of the plurality of pixels in the display panel 2 and (ii) a state in which a negative source signal is written in the each of the plurality of pixels in the display panel 2, are alternated every two frames, like "+, +, −, −, +, +, −, −, . . . ".

What is meant by "a spatial cycle of a polarity reversal of a source signal" is every how many pixels, in a direction on a plane of the display panel 2, a polarity reversal is carried out.

For example, in a case where the spatial cycle is set to "every two pixels", polarities of source signals written in pixels which are arranged in the direction are reversed every two pixels, like "+, +, −, −, +, +, −, −, . . . ".

There seem to be various methods in each of which the polarity reversal controlling section 20 determines the temporal cycle and/or the spatial cycle. Embodiment 1 is, however, not limited to a specific one. Note that the polarity reversal controlling section 20 can employ any of such various methods.

For example, the polarity reversal controlling section 20 can have a lookup table in which refresh rates are correlated in advance with temporal cycles and/or spatial cycles. By referring to the lookup table, the polarity reversal controlling section 20 can determine a temporal cycle and/or a spatial cycle in accordance with a changed refresh rate.

Alternatively, the polarity reversal controlling section 20 can have calculation logic for calculating a temporal cycle and/or a spatial cycle on the basis of a refresh rate. In this case, the polarity reversal controlling section 20 can calculate the temporal cycle and/or the spatial cycle on the basis of a refresh rate which is changed in accordance with instruction of an external section.

Alternatively, the polarity reversal controlling section 20 can have calculation logic for calculating a temporal cycle and/or a spatial cycle on the basis of a ratio of change in refresh rate. In this case, the polarity reversal controlling section 20 can calculate the temporal cycle and/or the spatial cycle on the basis of the ratio of change in refresh rate.

Note that the temporal cycle and/or the spatial cycle can be determined by the external section such as the system-side control section 30, and then the polarity reversal controlling section 20 is instructed, in response to a control signal from the external section, to change a current temporal cycle and/or spatial cycle to the temporal cycle and/or the spatial cycle thus determined.

(Example of Polarity Reversal Methods)

Figure 2:
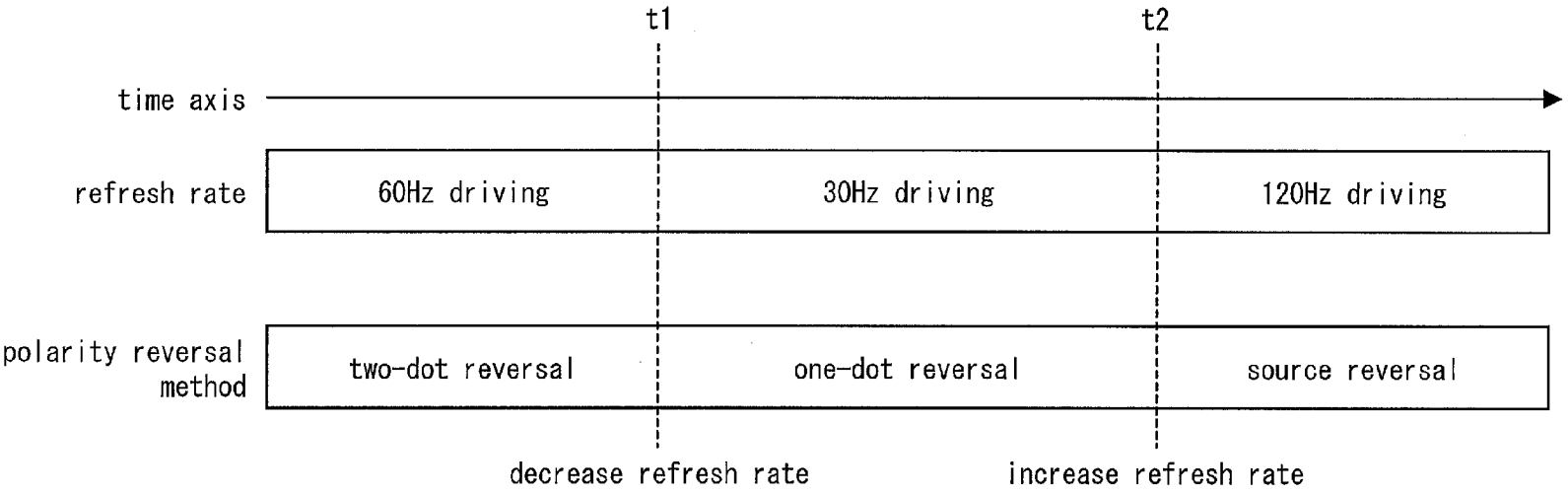
FIG. 2 is a conceptual diagram illustrating a modification of a polarity reversal method by a polarity reversal controlling section of Embodiment 1.

The following description will discuss, with reference to FIG. 2, how the polarity reversal controlling section 20 of Embodiment 1 changes the polarity reversal method. FIG. 2 is a conceptual diagram illustrating how the polarity reversal controlling section 20 of Embodiment 1 changes the polarity reversal method.

The polarity reversal controlling section 20 of Embodiment 1 can carry out a polarity reversal control. For example, "the polarity reversal controlling section 20 of Embodiment 1 can change a spatial cycle of a polarity reversal of a source signal, in a case where the refresh rate of the display panel 2 is changed."

Specifically, the polarity reversal controlling section 20 can carry out a polarity reversal control in which "the polarity reversal controlling section 20 shortens the spatial cycle, in a case where the refresh rate of the display panel 2 is decreased".

Furthermore, the polarity reversal controlling section 20 can carry out a polarity reversal control in which "the polarity reversal controlling section 20 lengthens the spatial cycle, in a case where the refresh rate of the display panel 2 is increased".

As illustrated in FIG. 2, the refresh rate of the display panel 2 is initially set to "60 Hz." In accordance with such a setting, the polarity reversal method is set to "two-dot reversal method." What is meant by the "two-dot reversal method" is a polarity reversal method in which a polarity of a source signal is reversed on a spatial cycle, i.e., "every two pixels." As such, "two-dot reversal" is also called "2H dot reversal".

At timing t1, the refresh rate of the display panel 2 is decreased from "60 Hz" to "30 Hz." That is, the refresh rate of the display panel 2 is decreased to be less than "35 Hz." Accordingly, the polarity reversal controlling section 20 changes the polarity reversal method from "two-dot reversal method" to "one-dot reversal method" at the timing t1. What is meant by "one-dot reversal method" is a polarity reversal method in which a polarity of a source signal is reversed on a spatial cycle, i.e., "for each pixel." That is, at the timing t1, the spatial cycle of the polarity reversal of the source signal is shortened in accordance with the decrease in refresh rate.

At timing t2, the refresh rate of the display panel 2 is increased from "30 Hz" to "120 Hz". That is, the refresh rate of the display panel 2 is increased to be higher than "65 Hz". Accordingly, the polarity reversal controlling section 20 changes the polarity reversal method from "one-dot reversal method" to "source reversal method" at the timing t2. What is meant by the "source reversal method" is a polarity reversal method in which a polarity of a source signal is reversed on a spatial cycle, i.e., "for each pixel column". That is, at the timing t2, the spatial cycle of the polarity reversal of the source signal is lengthened in accordance with the increase in refresh rate.

(Embodiment 2)

Figure 3:
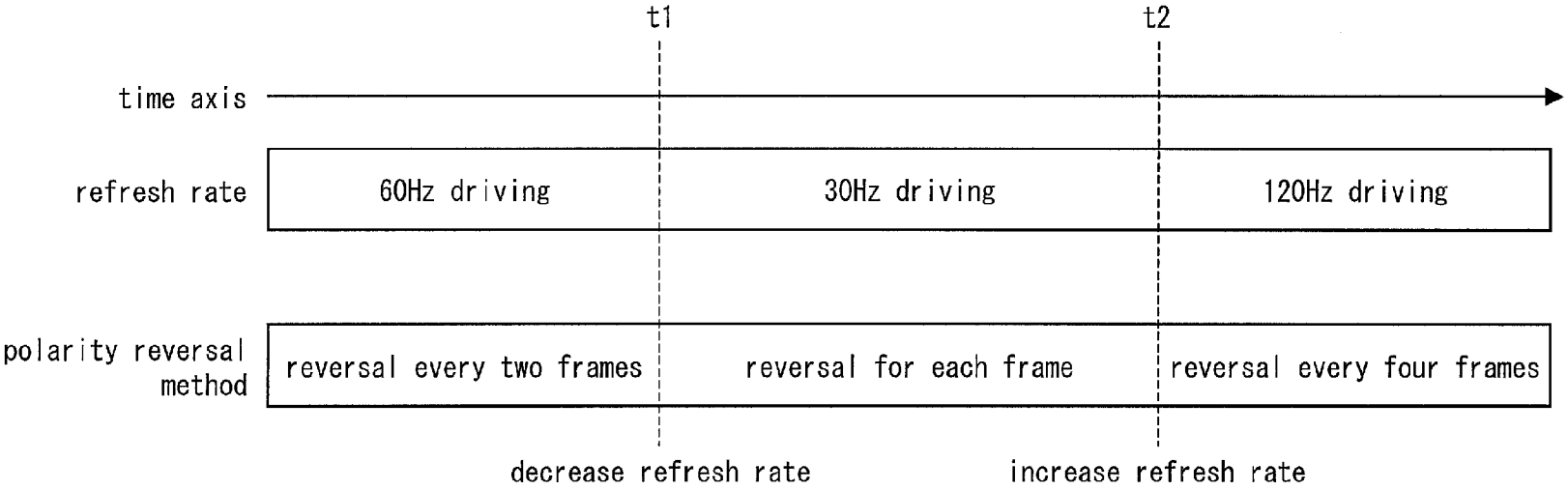
FIG. 3 is a conceptual diagram illustrating a modification of a polarity reversal method by a polarity reversal controlling section of Embodiment 2.

The following description will discuss Embodiment 2 of the present invention with reference to FIG. 3. A display device of Embodiment 2 differs from the display device 1 of Embodiment 1 in the following description. Therefore, descriptions other than that will be omitted.

(Another Example of Polarity Reversal Methods)

A modification of the polarity reversal method by the polarity reversal controlling section 20 of Embodiment 2 will be described below. FIG. 3 is a conceptual diagram illustrating the modification of the polarity reversal method by the polarity reversal controlling section 20 of Embodiment 2.

The polarity reversal controlling section 20 of Embodiment 2 can carry out a polarity reversal control in which "the polarity reversal controlling section 20 of Embodiment 2 changes a temporal cycle of a polarity reversal of a source signal, in a case where a refresh rate of a display panel 2 is changed".

Specifically, the polarity reversal controlling section 20 can carry out a polarity reversal control in which "the polarity reversal controlling section 20 shortens the temporal cycle, in a case where the refresh rate of the display panel 2 is decreased".

Furthermore, the polarity reversal controlling section 20 can carry out a polarity reversal control in which "the polarity reversal controlling section 20 lengthens the temporal cycle, in a case where the refresh rate of the display panel 2 is increased".

As illustrated in FIG. 3, the refresh rate of the display panel 2 is initially set to "60 Hz". In accordance with such a setting, the polarity reversal method is set to "reversal every two frames". What is meant by the "reversal every two frames" is a polarity reversal method in which a polarity of a source signal is reversed on a temporal cycle, i.e., "every two frames".

At timing t1, the refresh rate of the display panel 2 is decreased from "60 Hz" to "30 Hz". That is, the refresh rate of the display panel 2 is decreased to be less than "35 Hz". Accordingly, the polarity reversal controlling section 20 changes the polarity reversal method from "reversal every two frames" to "reversal for each frame" at the timing t1. What is meant by the "reversal for each frame" is a polarity reversal method in which a polarity of a source signal is reversed on a temporal cycle, i.e., "for each frame". That is, at the timing t1, the temporal cycle of the polarity reversal of the source signal is shortened in accordance with the decrease in refresh rate.

Note here that "the temporal cycle is shortened" is intended to mean that the number of unit frames every which polarity reversal is carried out, is reduced, and is therefore not intended to mean absoluteness in which timing of polarity reversal comes earlier.

At timing t2, the refresh rate of the display panel 2 is increased from "30 Hz" to "120 Hz". That is, the refresh rate of the display panel 2 is increased to be higher than "65 Hz". Accordingly, the polarity reversal controlling section 20 changes the polarity reversal method from "reversal for each frame" to "reversal every four frames" at the timing t2. What is meant by the "reversal every four frames" is a polarity reversal method in which a polarity of a source signal is reversed on a temporal cycle, i.e., "every four frames". That is, at the timing t2, the temporal cycle of the polarity reversal of the source signal is lengthened in accordance with the increase in refresh rate.

Note here that "the temporal cycle is lengthened" is intended to mean that the number of unit frames, every which polarity reversal is carried out, is increased, and is therefore not intended to mean absoluteness in which timing of polarity reversal is delayed.

The following description will specifically discuss polarity reversal methods with reference to FIGS. 4 through 7. Note here that polarity reversal methods will be described below by use of pixels, arranged in six pixel columns and in four pixel rows, which are parts of a plurality of pixels that are included in a display panel 2.

Figure 4:
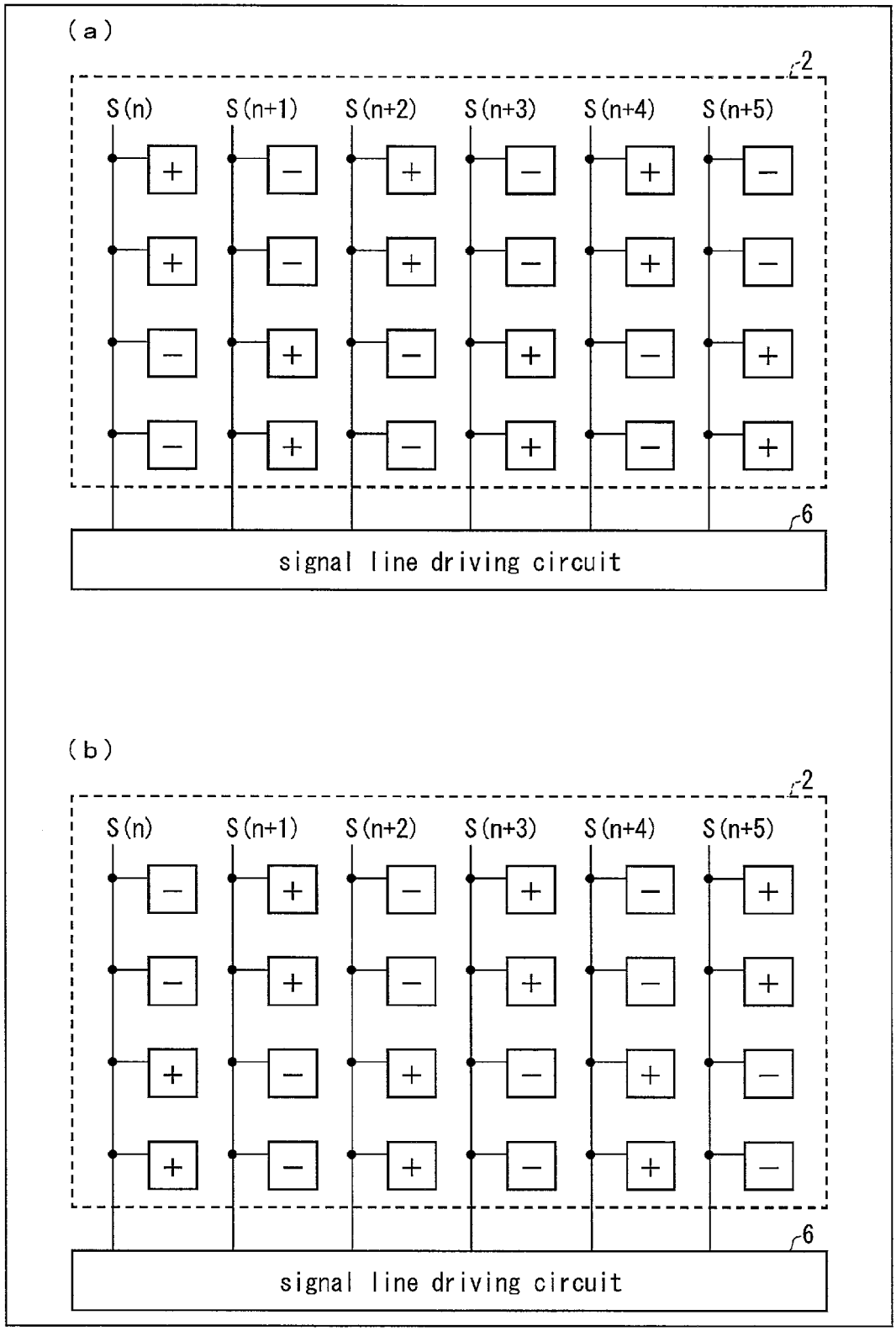
FIG. 4 is a view illustrating a display panel which is in a state where source signals are written by use of a polarity reversal method, i.e., "two-dot reversal method".
Figure 5:
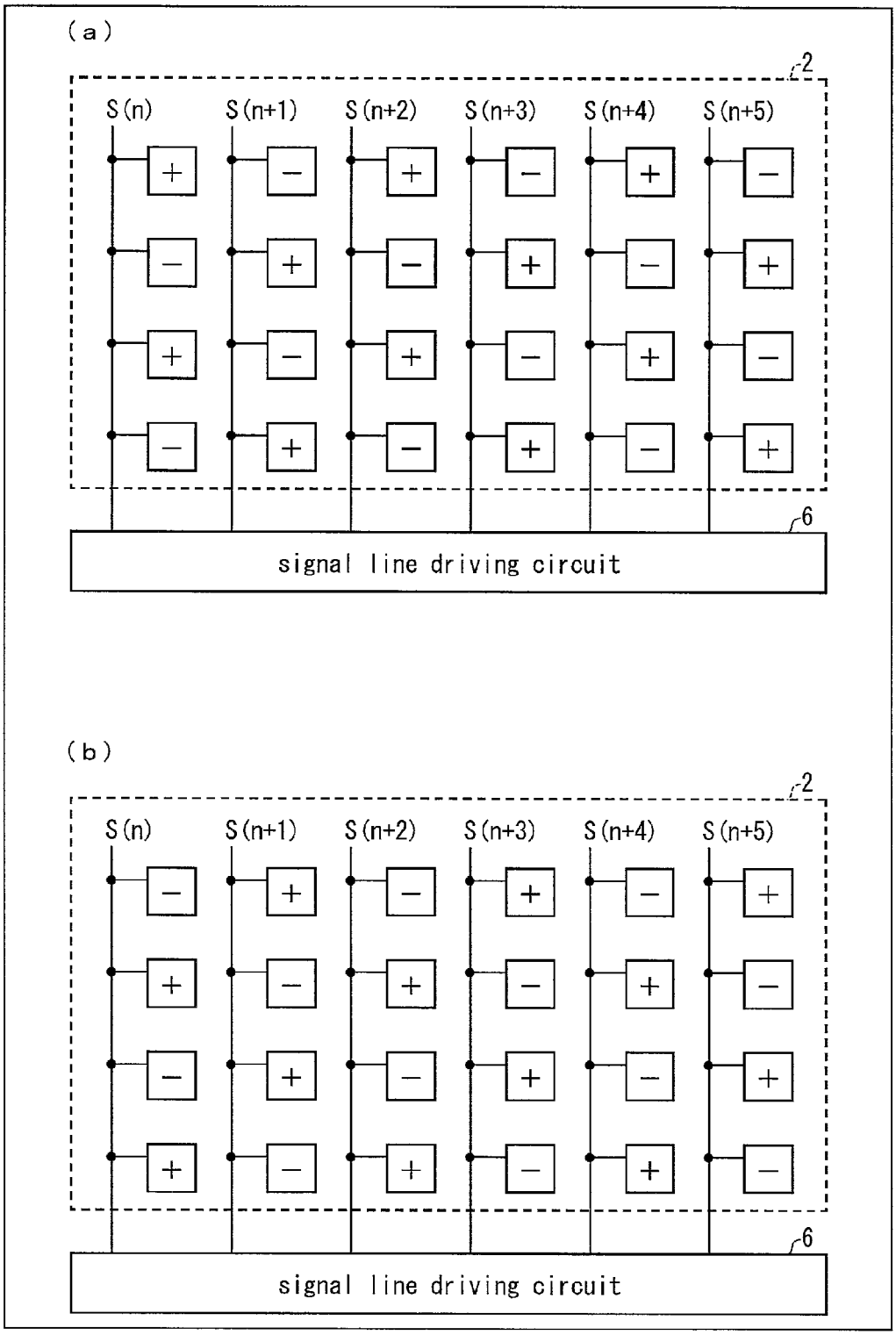
FIG. 5 is a view illustrating a display panel which is in a state where source signals are written by use of a polarity reversal method, i.e., "one-dot reversal method".
Figure 6:
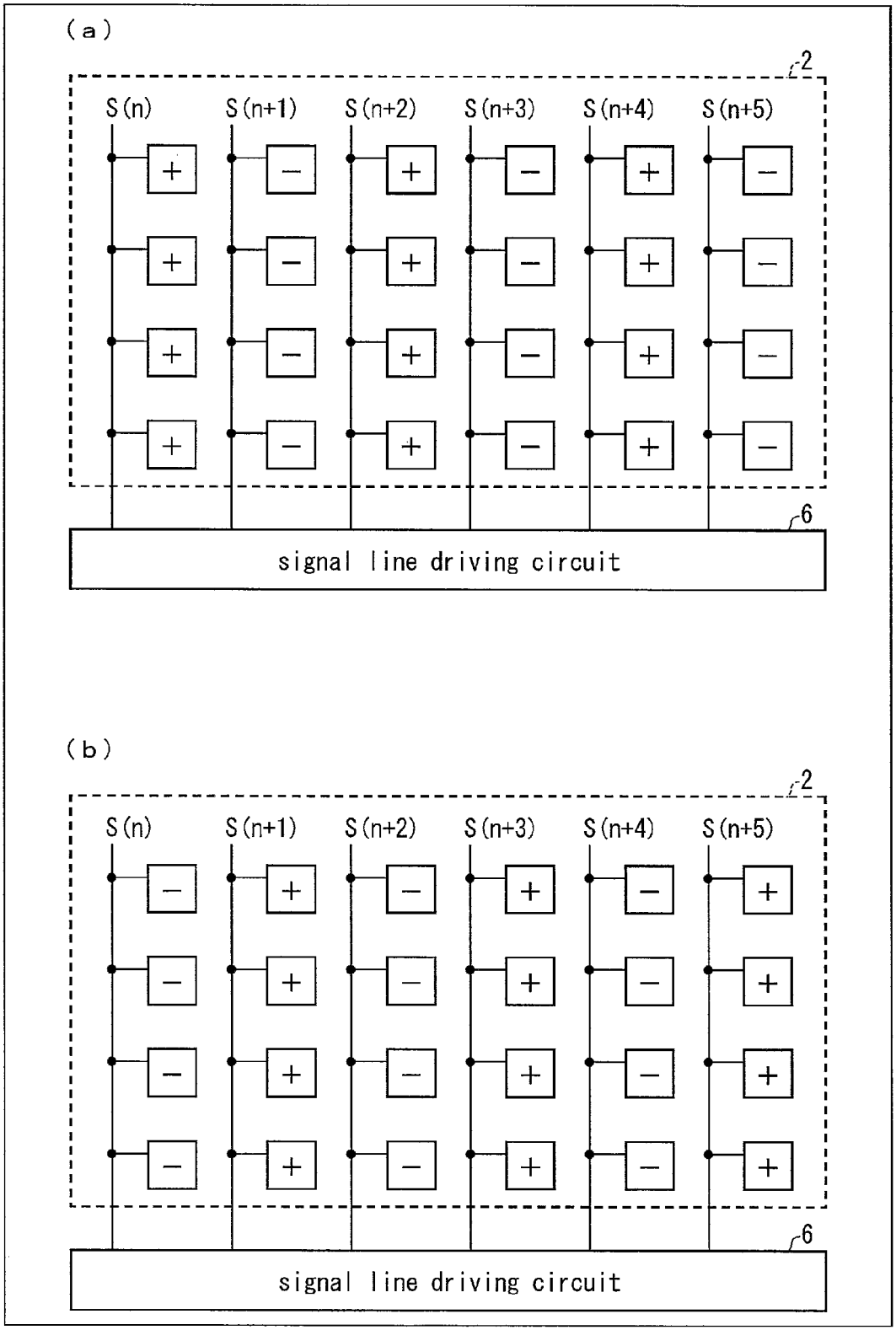
FIG. 6 is a view illustrating a display panel which is in a state where source signals are written by use of a polarity reversal method, i.e., "source reversal method".
Figure 7:
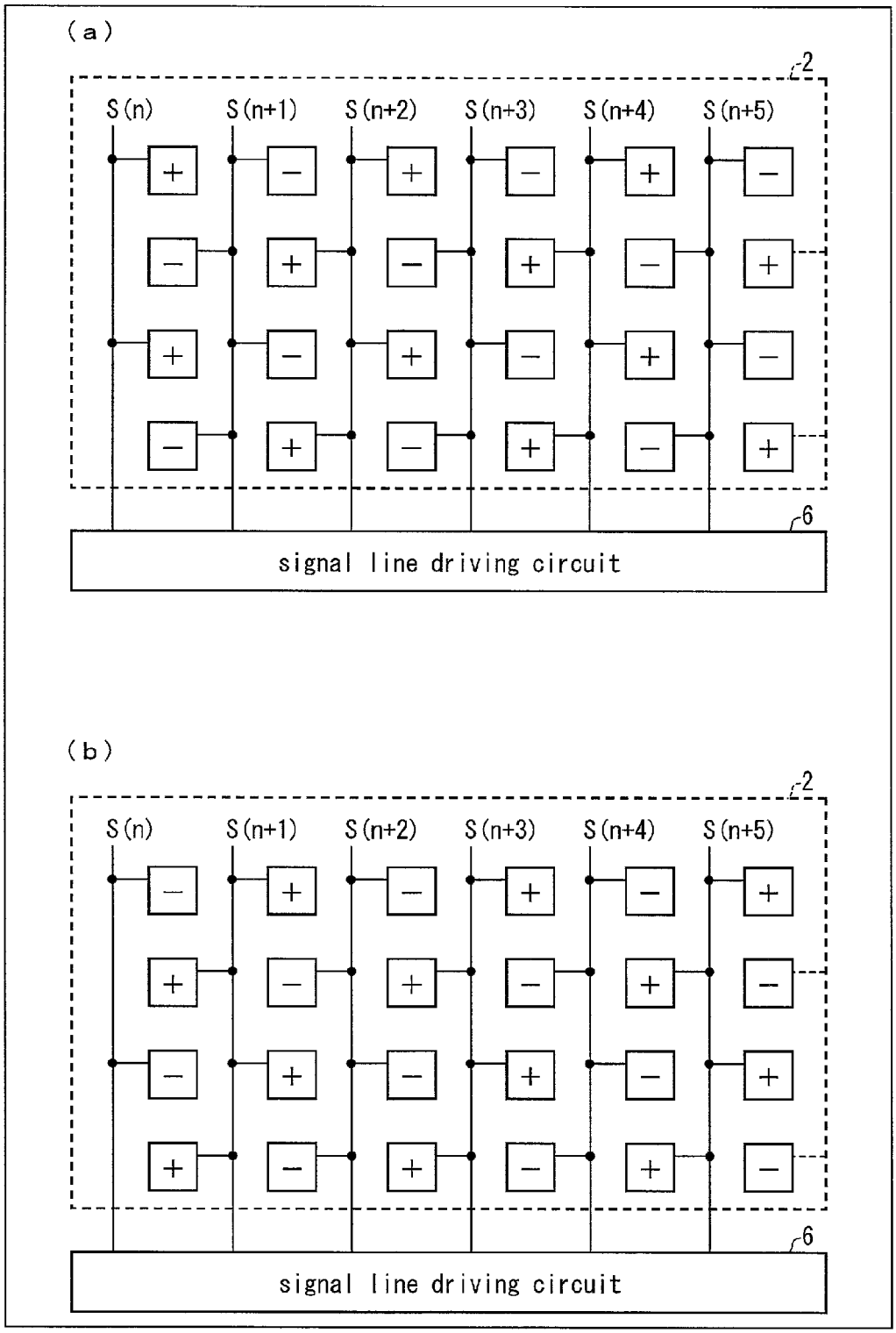
FIG. 7 is a view illustrating a display panel which is in a state where source signals are written by use of a polarity reversal method, i.e., "source reversal method".

FIG. 4 is a view illustrating a display panel 2 which is in a state where source signals are written by use of the polarity reversal method, i.e., the "two-dot reversal method." FIG. 5 is a view illustrating a display panel 2 which is in a state where source signals are written by use of the polarity reversal method, i.e., the "one-dot reversal method." FIGS. 6 and 7 each are a view illustrating a display panel 2 which is in a state where source signals are written by use of the polarity reversal method, i.e., "source reversal method".

In each of FIGS. 4 through 7, "+" represents a state in which a positive source signal is written in a pixel, and "−" represents a state in which a negative source signal is written in a pixel. (a) and (b) of each of FIGS. 4 through 7 are different from each other in that a polarity of a source signal written in each of the pixels illustrated in (a) is reversed to that of a source signal written in a corresponding one of the pixels illustrated in (b).

(Spatial Cycle of Polarity Reversal)

As illustrated in FIG. 4, according to the "two-dot reversal method," polarities of source signals written in pixels which are arranged in each pixel column are reversed every two pixels, like "+, +, −, −" or "−, −, +, +."

As illustrated in FIG. 5, according to the "one-dot reversal method", polarities of source signals written in pixels which are arranged in each pixel column are reversed for each pixel, like "+, −, +, −" or "−, +, −, +".

As illustrated in FIG. 6, according to the "source reversal method", polarities of source signals written in pixels which are arranged in each pixel column are identical to one another. That is, the pixels arranged in the each pixel column have respective polarities "+, +, +, +" or "−, −, −, −". Alternatively, polarities of source signals are reversed for each pixel column in the display panel 2, like "+, −, +, −" or "−, +, −, +".

Similar to the display panel 2 illustrated in FIG. 6, a display panel 2 illustrated in FIG. 7 employs the "source reversal method." However, the display panel 2 illustrated in FIG. 7 is different from that illustrated in FIG. 6 in how a plurality of pixels, each of which is connected to a corresponding source signal line S, are arranged. Specifically, according to the display panel 2 illustrated in FIG. 6, pixels, connected to a same source signal line S, are arranged along a corresponding pixel column. In contrast, according to the display panel 2 illustrated in FIG. 7, pixels, connected to a same source signal line S, are alternately arranged along two pixel columns between which the same signal source signal line S is sandwiched.

With the arrangement, although the display panel 2 illustrated in FIG. 7 employs the "source reversal method," pixels arranged along a corresponding pixel column are so that a polarity of a source signal is reversed for each pixel, as with the "one-dot reversal method," i.e. "+, −, +, −" or "−, +, −, +."

Thus, examples of the polarity reversal method to be employed by the display device 1 include a plurality of polarity reversal methods which are different in spatial cycle of a polarity reversal of a source signal. The polarity reversal controlling section 20 controls which one of the polarity reversal methods the display device 1 employs to be determined in accordance with a change in refresh rate of the display panel 2.

(Temporal Cycle of Polarity Reversal)

In any case where the display panel 2 employs (i) the "two-dot reversal method" illustrated in FIG. 4, (ii) the "one-dot reversal method" illustrated in FIG. 5, (iii) the "source reversal method" illustrated in FIG. 6, or (iv) the "source reversal method" illustrated in FIG. 7, a state illustrated in (a) and a state illustrated in (b) are alternated, on a certain temporal cycle, in the display panel 2. That is, the polarity of each of the pixels in the display panel 2 is reversed on the certain temporal cycle.

For example, in a case where the polarity reversal controlling section 20 sets the polarity reversal method to the "reversal for each frame", (i) a first state where a positive source signal is written in each of the plurality of pixels in the display panel 2 and (ii) a second state where a negative source signal is written in the each of the plurality of pixels in the display panel 2, are alternated for each frame, like"+, −, +, −, +, −, +, −, . . . ".

In a case where the polarity reversal controlling section 20 sets the polarity reversal method to the "reversal every two frames", the first state and the second state are alternated every two frames, like "+, +, −, −, +, +, −, −, . . . ".

In a case where the polarity reversal controlling section 20 sets the polarity reversal method to the "reversal every four frames", the first state and the second state are alternated every four frames, like "+, +, +, +, −, −, −, −, . . . ".

Thus, examples of the polarity reversal method to be employed by the display device 1 include a plurality of polarity reversal methods which are different in temporal cycle of a polarity reversal of a source signal. The polarity reversal controlling section 20 controls which one of the polarity reversal methods the display device 1 employs to be determined in accordance with a change in refresh rate of the display panel 2.

(Effect)

As has been described, each of the display devices 1 of Embodiments 1 and 2 employs the configuration in which the temporal cycle or the spatial cycle is changed in accordance with the change in refresh rate of the display panel 2.

In especial, each of the display devices 1 of Embodiments 1 and 2 employs the configuration in which (i) the temporal cycle or the spatial cycle is shortened, in a case where the refresh rate is decreased, and (ii) the temporal cycle or the spatial cycle is lengthened, in a case where the refresh rate is increased.

According to the configuration, even in a case where a display quality of the display device 1 of Embodiment 1 or 2 is deteriorated due to a decrease in refresh rate, it is possible to suppress such a deterioration in display quality by shortening the temporal cycle or the spatial cycle. Furthermore, even in a case where power consumption of the display device 1 of Embodiment 1 or 2 is increased due to an increase in refresh rate, it is possible to suppress such an increase in power consumption by lengthening the temporal cycle or the spatial cycle.

Each of the display devices 1 of Embodiments 1 and 2 further employs the configuration in which the temporal cycle or the spatial cycle is changed in (i) a case where the refresh rate is decreased to be less than 35 Hz or (ii) a case where the refresh rate is increased to be more than 65 Hz.

According to the configuration, the display device 1 of Embodiment 1 or 2 can change the temporal cycle or the spatial cycle at a more appropriate timing such as (i) a case where a display defect such as flicker is easily caused or (ii) a case where the power consumption is easily increased.

(Embodiment 3)

Figure 8:
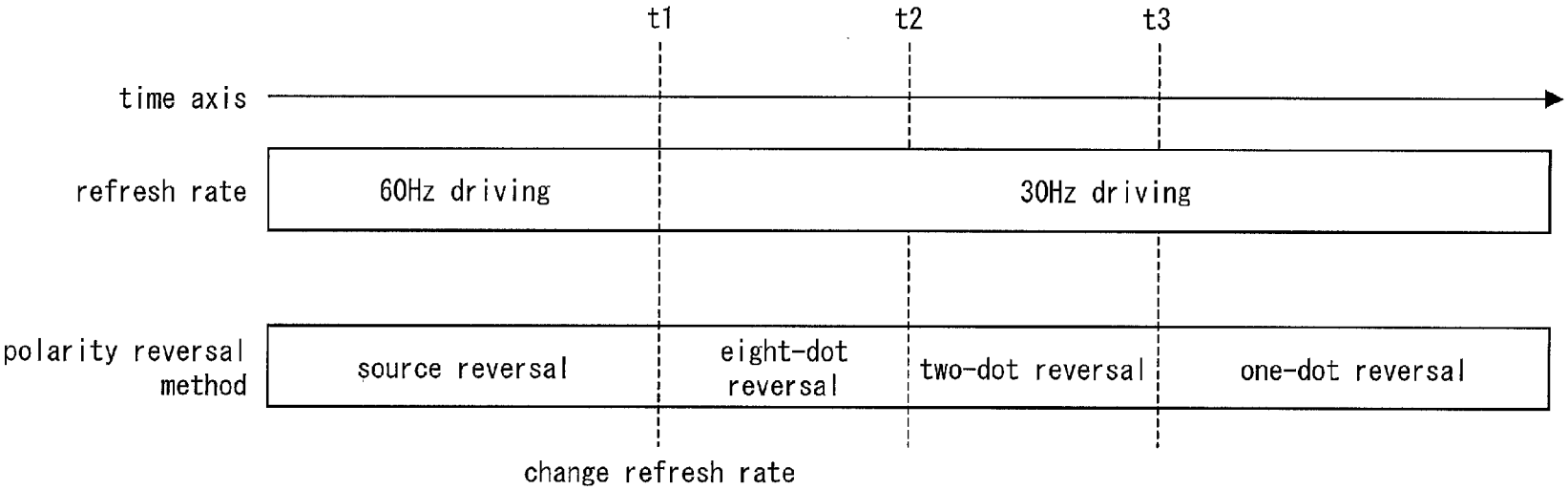
FIG. 8 is a conceptual diagram illustrating a modification of a polarity reversal method by a polarity reversal controlling section of Embodiment 3.

The following description will discuss Embodiment 3 of the present invention with reference to FIG. 8. A display device 1 of Embodiment 3 differs from the display devices 1 of Embodiments 1 and 2 in the following description. Therefore, descriptions other than that will be omitted.

(Example of Polarity Reversal Methods)

A modification of a polarity reversal method by a polarity reversal controlling section 20 of Embodiment 3 will be described below. FIG. 8 is a conceptual diagram illustrating the modification of the polarity reversal method by the polarity reversal controlling section of Embodiment 3.

The polarity reversal controlling section 20 of Embodiment 3 can carry out a polarity reversal control in which "the polarity reversal controlling section 20 of Embodiment 3 gradually shortens a spatial cycle of a polarity reversal of a source signal, in a case where a refresh rate of a display panel 2 is decreased".

As illustrated in FIG. 8, the refresh rate of the display panel 2 is initially set to "60 Hz". In accordance with such a setting, the polarity reversal method is set to "source reversal method".

At timing t1, the refresh rate of the display panel 2 is decreased from "60 Hz" to "30 Hz". Accordingly, the polarity reversal controlling section 20 changes the polarity reversal method from the "source reversal method" to "eight-dot reversal method" at the timing t1.

At timing t2, the polarity reversal controlling section 20 changes the polarity reversal method from the "eight-dot reversal method" to the "two-dot reversal method", while the refresh rate of the display panel 2 is still being set to "30 Hz".

At timing t3, the polarity reversal controlling section 20 changes the polarity reversal method from the "two-dot reversal method" to the "one-dot reversal method", while the refresh rate of the display panel 2 is still being set to "30 Hz".

That is, according to Embodiment 3, the polarity reversal controlling section 20 does not shorten the spatial cycle from for each pixel column directly to for each pixel at timing when the refresh rate of the display panel 2 is decreased from "60 Hz" to "30 Hz," but gradually (that is, step by step) shortens the spatial cycle from for each pixel column to every eight pixels, from every eight pixels to every two pixels, and finally from every two pixels to for each pixel.

Though not specifically described, the polarity reversal controlling section 20 of Embodiment 3 can carry out a polarity reversal control in which "the polarity reversal controlling section 20 of Embodiment 3 gradually lengthens the spatial cycle, in a case where the refresh rate of the display panel 2 is increased".

(Embodiment 4)

Figure 9:
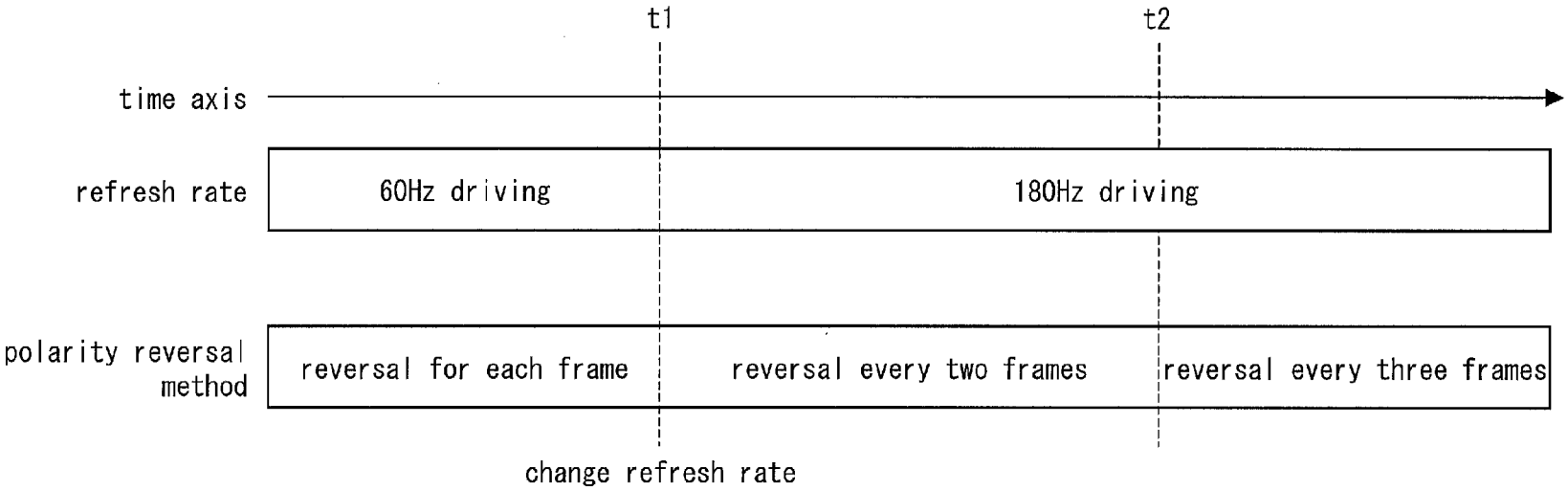
FIG. 9 is a conceptual diagram illustrating a modification of a polarity reversal method by a polarity reversal controlling section of Embodiment 4.

The following description will discuss Embodiment 4 of the present invention with reference to FIG. 9. A display device 1 of Embodiment 4 differs from the display devices 1 of Embodiments 1 through 3 in the following description. Therefore, descriptions other than that will be omitted.

(Example of Polarity Reversal Methods)

A modification of a polarity reversal method by a polarity reversal controlling section 20 of Embodiment 4 will be described below. FIG. 9 is a conceptual diagram illustrating the modification of the polarity reversal method by the polarity reversal controlling section 20 of Embodiment 4.

The polarity reversal controlling section 20 of Embodiment 4 can carry out a polarity reversal control in which "the polarity reversal controlling section 20 of Embodiment 4 gradually lengthens a temporal cycle of a polarity reversal of a source signal, in a case where a refresh rate of a display panel 2 is increased".

As illustrated in FIG. 9, the refresh rate of the display panel 2 is initially set to "60 Hz". In accordance with such a setting, the polarity reversal method is set to "reversal for each frame".

At timing t1, the refresh rate of the display panel 2 is increased from "60 Hz" to "180 Hz". Accordingly, the polarity reversal controlling section 20 changes the polarity reversal method from the "reversal for each frame" to "reversal every two frames" at the timing t1.

At timing t2, the polarity reversal controlling section 20 changes the polarity reversal method from the "reversal every two frames" to "reversal every three frames", while the refresh rate of the display panel 2 is still being set to "180 Hz".

That is, according to Embodiment 4, the polarity reversal controlling section 20 does not lengthen the temporal cycle from for each frame directly to every three frames at timing when the refresh rate of the display panel 2 is increased from "60 Hz" to "180 Hz", but gradually lengthens the temporal cycle from for each frame to every two frames, and finally from every two frames to every three frames.

Though not specifically described, the polarity reversal controlling section 20 of Embodiment 4 can carry out a polarity reversal control in which "the polarity reversal controlling section 20 of Embodiment 4 gradually shortens the temporal cycle, in a case where the refresh rate of the display panel 2 is decreased".

(Effect)

As has been described, each of the display devices 1 of Embodiments 3 and 4 employs the configuration in which the temporal cycle or the spatial cycle is gradually changed in accordance with the change in refresh rate of the display panel 2. This enables each of the display devices 1 of Embodiments 3 and 4 to prevent a viewer from feeling odd while the temporal cycle or the spatial cycle is being changed.

Note that, in a case where the configuration, in which the temporal cycle or the spatial cycle is gradually changed, is employed, the number of frames is preferably an even number during a period of time during which the temporal cycle or the spatial cycle is employed while being changed. According to, for example, the example illustrated in FIG. 8, it is preferable that the number of frames be an even number during (i) a time period from t1 to t2 during which "every eight pixels" is employed while the spatial period is being changed and (ii) a time period from t2 to t3 during which "every two pixels" is employed while the spatial period is being changed.

According to the example illustrated in FIG. 9, it is preferable that the number of frames be an even number during a time period from t1 to t2 during which "every two frames" is employed while the temporal cycle is being changed.

For example, in a case where (i) a method of reversing a polarity of a source signal for each frame is employed while a temporal cycle is being changed and (ii) the number of frames is set to a multiple of 2 (i.e., an even number) while the temporal cycle is being changed, it is possible to write a positive source signal and a negative source signal in each of pixels, while the temporal cycle is being changed, so that the number of the writing of the positive source signal in the each of the pixels is equal to the number of the writing of the negative source signal in the each of the pixels.

Alternatively, in a case where (i) a method of reversing a polarity of a source signal every two frames is employed while a temporal cycle is being changed and (ii) the number of frames is set to a multiple of 4 (i.e., an even number) while the temporal cycle is being changed, it is possible to write a positive source signal and a negative source signal in the each of pixels, while the temporal cycle is being changed, so that the number of the writing of the positive source signal in the each of the pixels is equal to the number of the writing of the negative source signal in the each of the pixels.

That is, by setting the number of frames to an even number while the temporal cycle or the spatial cycle is being changed, it is possible to eliminate a deviation in polarities of source signals to be written in each of the pixels.

(Embodiment 5)

Figure 10:
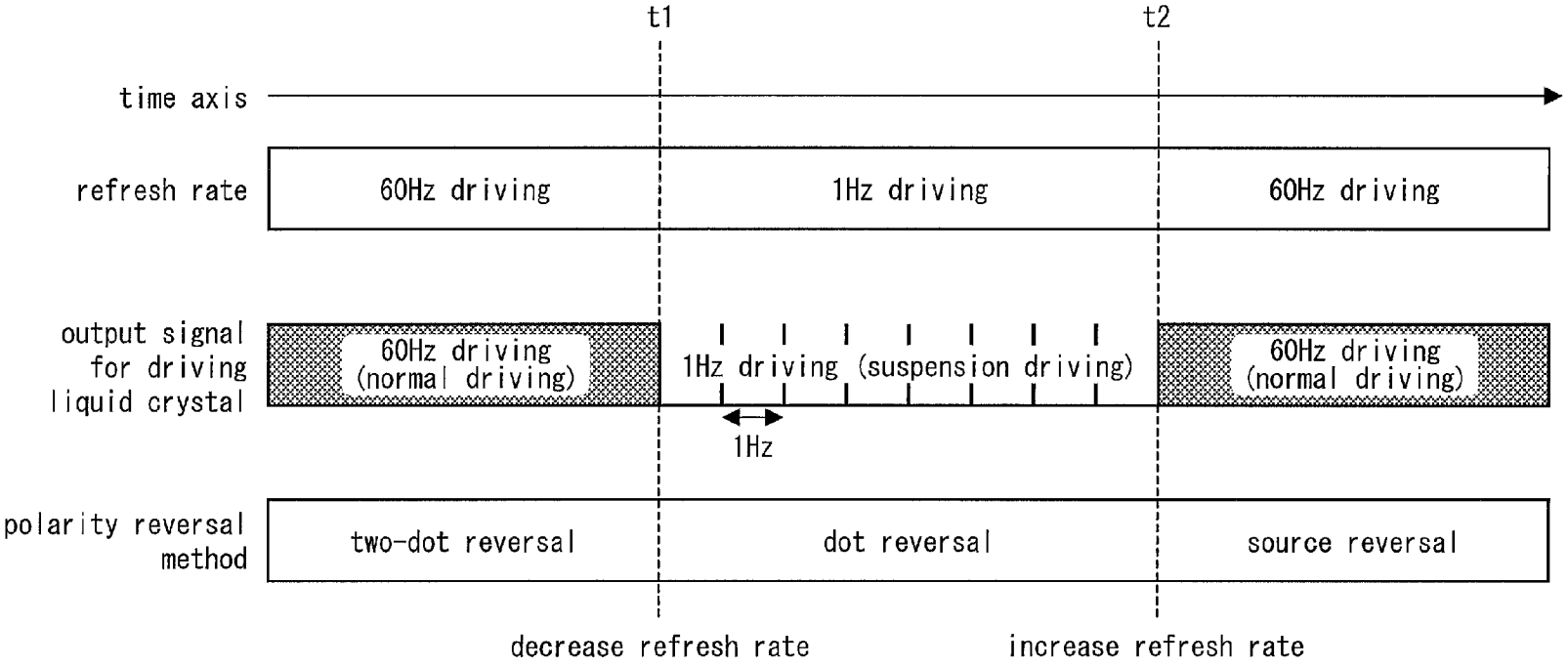
FIG. 10 is a conceptual diagram illustrating how a refresh rate changing section of Embodiment 5 changes a refresh rate.

The following description will discuss Embodiment 5 of the present invention with reference to FIG. 10. A display device 1 of Embodiment 5 differs from the display devices 1 of Embodiments 1 through 4 in the following description. Therefore, descriptions other than that will be omitted.

(How Refresh Rate is Changed)

How a refresh rate changing section 15 of Embodiment 5 changes a refresh rate will be described below. FIG. 10 is a conceptual diagram illustrating how the refresh rate changing section 15 of Embodiment 5 changes the refresh rate.

As has been described, the refresh rate changing section 15 of Embodiment 5 can change a current refresh rate of a display panel 2 to a refresh rate such as 30 Hz, 60 Hz, 120 Hz, or 180 Hz.

The refresh rate changing section 15 of Embodiment 5 can reduce a refresh rate of the display panel 2 by securing a suspension time period.

In FIG. 10, the refresh rate of the display panel 2 is initially set to "60 Hz" at which the display panel 2 is normally driven. This causes a polarity reversal method to be set to a "two-dot reversal method."

At timing t1, the refresh rate of the display panel 2 is decreased from "60 Hz" to "1 Hz". This causes a polarity reversal controlling section 20 to change the polarity reversal method from the "two-dot reversal method" to a "one-dot reversal method" at the timing t1.

At timing 2, the refresh rate of the display panel 2 is increased from "1 Hz" to "60 Hz". This causes the polarity reversal controlling section 20 to change the polarity reversal method from the "one-dot reversal method" to a "source reversal method" at the timing 2.

According to Embodiment 5, the refresh rate changing section 15 decreases the refresh rate of the display panel 2 from "60 Hz" to "1 Hz", particularly, by securing a suspension time period during which the display panel 2 is not driven.

Specifically, the refresh rate changing section 15 decreases the refresh rate of the display panel 2 from "60 Hz" to "1 Hz" by securing, in 1 (one) second, (i) a time period corresponding to "1 (one) frame" (that is, 1/60 second) during which image data is written and (ii) a suspension time period corresponding to "59 frames" (that is, 59/60 second) during which no image data is written.

According to the display device 1 of Embodiment 5, the refresh rate can be similarly changed to a frequency other than "1 Hz." For example, in a case where the refresh rate of the display panel 2 is decreased from "60 Hz" to "30 Hz", the refresh rate of the display panel 2 can be decreased to "30 Hz" by securing, in 1 (one) second, (i) a time period corresponding to "30 frames" (that is, 30/60 second) during which image data is written and (ii) a suspension time period corresponding to "30 frames" (that is, 30/60 second) during which no image data is written.

According to the display device 1 of Embodiment 5, the refresh rate can be thus decreased by securing a suspension time period during which no image data is written. This enables the display device 1 of Embodiment 5 to reduce more power consumption, as compared with decreasing the refresh rate instead of securing any suspension time period.

Particularly, according to the display device 1 of Embodiment 5, each pixel employs a TFT made from oxide semiconductor having a remarkably excellent OFF characteristic (later described). It is therefore possible to maintain, over an extended time period, a state in which image data is written in each pixel. As such, even in a case where the refresh rate is decreased, the display device 1 of Embodiment 5 can maintain a quality of an image to be displayed.

(How Pixel is Configured)

Figure 11:
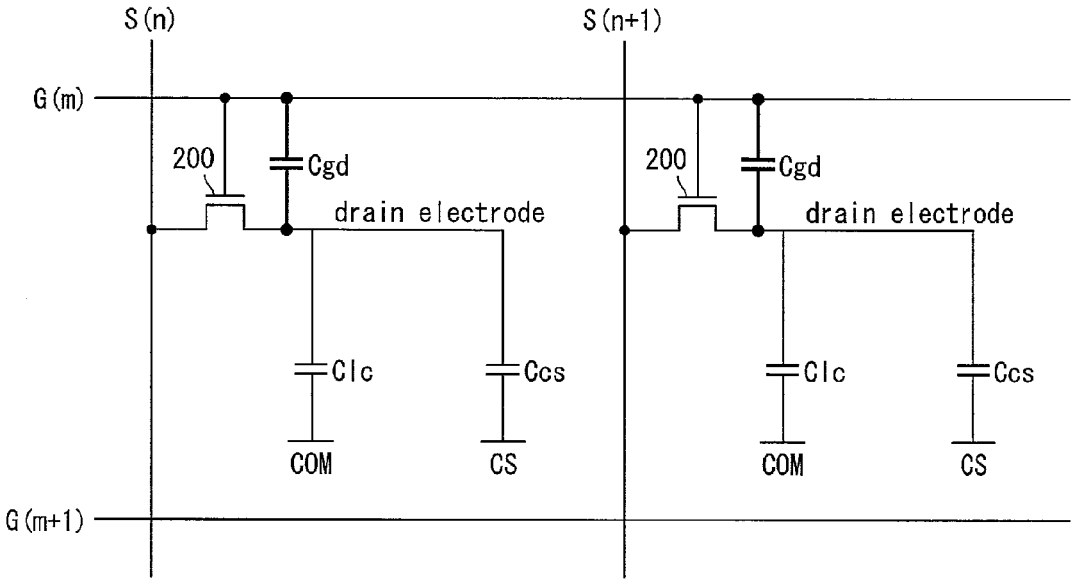
FIG. 11 is a view illustrating how pixels, which are included in a display panel 2, are configured.

The following description will discuss how pixels included in a display panel 2 are configured. FIG. 11 is a view illustrating how the pixels are configured. Specifically, FIG. 2 illustrates how two pixels, i.e., a pixel (n, m) and a pixel (n+1, m) of the pixels are configured. The pixel (n, m) indicates a pixel connected to a source signal line S(n) and a gate signal line G(m). The pixel (n+1, m) indicates a pixel connected to a source signal line S(n+1) and the gate signal line G(m). Note that pixels, other than the pixel (n, m) and the pixel (n+1, m), which are included in the display panel 2 are identical in configuration to the pixel (n, m) and the pixel (n+1, m).

As illustrated in FIG. 2, each of the pixel (n, m) and the pixel (n+1, m) includes a corresponding TFT 200 serving as a switching element. A gate electrode of the corresponding TFT 200 is connected to a corresponding gate signal line G. A source electrode of the corresponding TFT 200 is connected to a corresponding source signal line S. A drain electrode of the corresponding TFT 200 is connected to a corresponding liquid crystal capacitor Clc and a corresponding retention capacitor Ccs.

In a case where image data is written in each of the pixel (n, m) and the pixel (n+1, m), an ON voltage is supplied to the gate electrode of the corresponding TFT 200, via the corresponding gate signal line G. This causes the corresponding TFT 200 to be turned on.

While the corresponding TFT 200 is in an ON state, in a case where a source signal is supplied, via the corresponding source signal line S, to the drain electrode of the corresponding TFT 200, the source signal is supplied from the drain electrode to (i) a pixel electrode of the corresponding liquid crystal capacitor Clc and (ii) the corresponding retention capacitor Ccs.

Such supplying of the source signal to the pixel electrode of the corresponding liquid crystal capacitor Clc causes a direction, in which liquid crystal which is sealed into a space between the pixel electrode and a common electrode is arranged, to be changed in accordance with a difference between a voltage of the source signal supplied to the pixel electrode and a voltage supplied to the common electrode. An image is displayed, in accordance with such a difference, on the display panel 2.

Furthermore, such supplying of the source signal to the retention capacitor Ccs causes the retention capacitor Ccs to store therein an electric charge in accordance with the voltage of the source signal supplied to the retention capacitor Ccs. The electric charge stored in the retention capacitor Ccs allows the each of the pixel (n, m) and the pixel (n+1, m) to keep, during a certain period of time, a state in which an image is being displayed.

In the display device 1 of Embodiment 1, a TFT made from so-called oxide semiconductor is employed as a TFT 200.

Particularly, an oxide of indium (In), gallium (Ga) and zinc (Zn), i.e., a so-called IGZO (InGaZnOx) is employed as the oxide semiconductor.

(TFT Characteristic)

Figure 12:
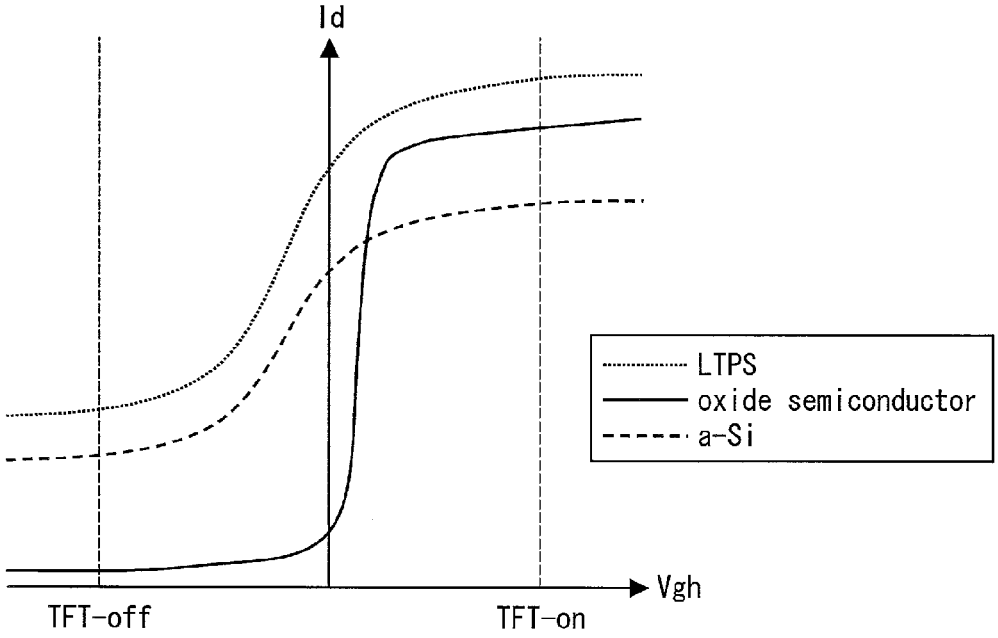
FIG. 12 is a view illustrating characteristics of various TFTs.

FIG. 12 illustrates characteristics of various types of TFTs. Specifically, FIG. 12 illustrates (i) a characteristic of a TFT made from oxide semiconductor, (ii) a characteristic of a TFT made from a-Si (amorphous silicon), and (iii) a characteristic of a TFT made from LTPS (Low Temperature PolySilicon).

In FIG. 12, (i) a lateral axis (Vgh) represents an ON voltage to be supplied to a gate of each of the TFTs, and (ii) a longitudinal axis (Id) represents an electric current which flows through a source and a drain of each of the TFTs.

In FIG. 12, (i) a time period "TFT-on" represents a time period during which a TFT is in an ON state in accordance with a supplied ON voltage and (ii) a time period "TFT-off" represents a time period during which a TFT is turned OFF in accordance with a supplied ON voltage.

As is clear from FIG. 12, during the time period "TFT-on", the TFT made from oxide semiconductor has a higher electron mobility than the TFT made from a-Si.

Specifically, an electric current Id of the TFT made from a-Si is 1 μA during the time period "TFT-on", whereas an electric current Id of the TFT made from oxide semiconductor falls within a range approximately from 20 μA to 50 μA during the time period "TFT-on" (not shown).

As is clear from the above, during the time period "TFT-on", the TFT made from oxide semiconductor has an electron mobility approximately 20 to 50 times higher than that of the TFT made from a-Si. As such, the TFT made from oxide semiconductor has a remarkably excellent ON characteristic.

As has been described, according to the display device 1 of the present embodiment, each of the pixels includes the TFT made from oxide semiconductor having such a remarkably excellent ON characteristic.

Since the display device 1 of the present embodiment employs the TFTs each having excellent ON characteristic, each pixel can be driven by use of a smaller-sized TFT. It is therefore possible to reduce a ratio of occupied area of a TFT in each pixel. That is, it is possible to increase an aperture ratio of each pixel, and is therefore possible to increase transmittance of backlight. In consequence, a low power consumption backlight can be employed and/or a luminance of the backlight can be lowered. This ultimately allows a reduction in power consumption of the display device 1.

Furthermore, since each TFT has such an excellent ON characteristic, it is possible to write a source signal in each pixel in a shorter time period. It is therefore possible to easily increase the refresh rate of the display panel 2.

Furthermore, during the time period "TFT-off", a leak electric current of the TFT made from oxide semiconductor is less than that of the TFT made from a-Si (see FIG. 12).

Specifically, the electric current Id of the TFT made from a-Si is 10 pA during the time period "TFT-off", whereas the electric current Id of the TFT made from oxide semiconductor is approximately 0.1 pA during the time period "TFT-off" (not shown).

As is clear from the above, the leak electric current of the TFT made from oxide semiconductor is approximately 1% of that of the TFT made from a-Si. It follows that the TFT made from oxide semiconductor hardly generates leak electric current. This shows that the TFT made from oxide semiconductor has a remarkably excellent OFF characteristic.

Since each TFT of the display device 1 of the present embodiment has a remarkably excellent OFF characteristic, it is possible to keep, over an extended time period, a state where a source signal is written in each pixel of the display panel. It is therefore possible to easily decrease the refresh rate of the display panel 2.

(Effect of Suppressing Flicker)

FIG. 13 is a table showing results of an experiment, made with respect to a display device, as to whether or not flicker is recognized. Specifically, with respect to a combination between (i) respective refresh rates of a display panel of the display device and (ii) respective spatial cycles of polarity reversals of source signals, the inventors of the present invention made an experiment as to whether any flicker was recognized on the display panel by visual observation while changing, appropriately by hand, settings of the refresh rates and the spatial cycles.

In this experiment, a 10.1-inch liquid crystal display device was used which includes a display panel that (i) has a resolution of "1280×800" and (ii) includes pixels each including a TFT made from a-Si.

From the result of the experiment, it was demonstrated that, in a case where the refresh rate of the display panel was set to not less than "40 Hz", no flicker was recognized regardless of the spatial cycle (see FIG. 13).

It was also demonstrated that (i), in a case where the refresh rate of the display panel was set to not more than "35 Hz", flicker was recognized and (ii) particularly, as the refresh rate was decreased, flicker was more recognized.

It was further demonstrated that, in the case where the refresh rate of the display panel was set to not more than "35 Hz", flicker was less recognized as the spatial cycle became shorter.

That is, from the result of the experiment, it was demonstrated that, though quality of an image to be displayed was deteriorated in a case where the refresh rate was decreased, such a deterioration can be suppressed by shortening the spatial cycle. The result of the experiment particularly demonstrates that, in a case where the refresh rate is set to not more than "35 Hz", it is necessary to greatly suppress the deterioration in the display quality.

The results of the experiment demonstrate that the display device 1 of the present embodiment, which employs the configuration in which "the spatial cycle is shortened in accordance with a decrease in refresh rate", can (i) reduce power consumption by decreasing the refresh rate and (ii) suppress the deterioration in the display quality by shortening the spatial cycle.

It is particularly demonstrated by the result of the experiment that the display device 1 of the present embodiment, which employs the configuration in which, "in a case where the refresh rate becomes less than 30 Hz, the temporal cycle or the spatial cycle is changed", can change the temporal cycle or the spatial cycle at a more appropriate timing.

(Effect of Reducing Power Consumption)

Figure 15:
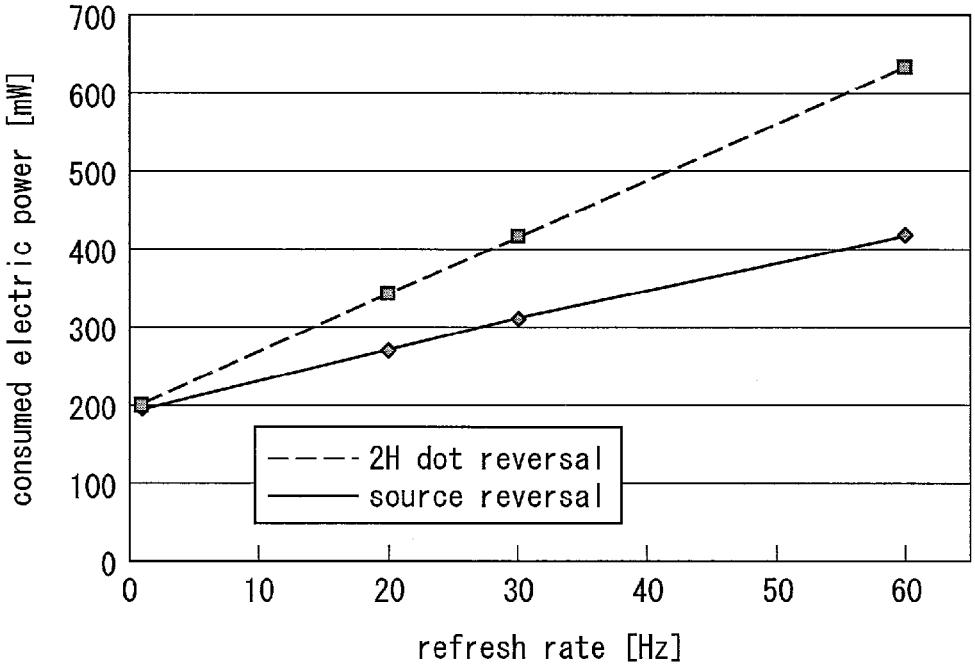
FIG. 15 is a graph illustrating the power consumption characteristic illustrated in FIG. 14.

FIG. 14 is a table illustrating a power consumption characteristic of a display device. FIG. 15 is a graph illustrating the power consumption characteristic illustrated in FIG. 14.

The power consumption characteristic is of a 10.8-inch liquid crystal display device in which each pixel employs a TFT made from oxide semiconductor.

As is clear from the power consumption characteristic, as a refresh rate of a display panel is decreased, power consumption of the display device is reduced.

Furthermore, as is clear from the power consumption characteristic, the power consumption can be reduced at any refresh rates by changing a polarity reversal method from a "2H dot reversal method" to a "source reversal method".

That is, as is clear from the power consumption characteristic, the power consumption can be reduced by decreasing the refresh rate of the display panel or by changing the polarity reversal method.

According to the display device, in a case where (i) the polarity reversal method is set to the "source reversal method" and (ii) the refresh rate is set to "60 Hz", the power consumption of the display device is "417.78 mW" (see (a) of FIG. 14).

In a case where the refresh rate is decreased from "60 Hz" to "30 Hz", the power consumption of the display device becomes "309.87 mW", that is, the power consumption is reduced by "107.91 mW".

In a case where the polarity reversal method is changed from the "source reversal method" to the "2H dot reversal method" so as to suppress a deterioration in display quality due to such a change in refresh rate from "60 Hz" to "30 Hz", the power consumption of the display device becomes "416.79 mW", that is, the power consumption of the display device is increased by "106.92 mW".

However, such an increased amount of the power consumption (106.92 mW) is less than such a reduced amount of the power consumption (107.91 mW) due to the change in refresh rate from "60 Hz" to "30 Hz". In consequence, the power consumption is reduced, and the deterioration in the display quality is suppressed.

As is clear from the above, even in a case where the power consumption is increased so as to suppress the deterioration in the display quality due to the decrease in the refresh rate, it is possible to keep the increased amount of the power consumption less than the reduced amount of the power consumption due to the decrease in the refresh rate.

It is therefore demonstrated that the display device 1 of the present embodiment, which employs the configuration in which "(i) the power consumption is reduced by decreasing the refresh rate, and (ii) the deterioration in the display quality is suppressed by shortening a spatial cycle of a polarity reversal of a source signal", can reduce the power consumption, and can suppress the deterioration in the display quality.

Note that, as is clear from FIGS. 14 and 15, in a case where the refresh rate is set to not less than "65 Hz", it is necessary to greatly reduce the power consumption.

It is therefore demonstrated that the display device 1 of the present embodiment, which employs the configuration in which "in a case where the refresh rate is increased to be more than 65 Hz, the temporal cycle or the spatial cycle is changed", can change the temporal cycle or the spatial cycle at a more appropriate timing.

(Supplementary Description)

The embodiments of the present invention have been described. However, the present invention is not limited to the description of the embodiments above, and can therefore be modified by a skilled person in the art within the scope of the claims. Namely, an embodiment derived from a proper combination of technical means disclosed in different embodiments is encompassed in the technical scope of the present invention.

In the above embodiments, each of the refresh rate, the temporal cycle of the reversal polarity of the source signal, and the spatial cycle of the polarity reversal of the source signal is set to various values. However, such values are illustrative only. Needless to say, each of the refresh rate, the temporal cycle of the reversal polarity of the source signal, and the spatial cycle of the polarity reversal of the source signal can be changed as appropriate according to, for example, a characteristic of a display device.

In the above embodiments, the spatial cycle of the polarity reversal of the source signal is set to (i) every some pixels in a pixel column direction or (ii) for each pixel column. However, they are illustrative only. The spatial cycle can be set to (i) every some pixels in a pixel row direction, (ii) for each pixel row, (iii) for each screen or every some screens (for each frame or every some frames), or (iv) for each block made up of pixels arranged in a matrix manner.

The above embodiments have described an example case where the present invention is applied to the display device in which each of the pixels employs the TFT made from oxide semiconductor. However, the present invention is not limited to the example case. The present invention is applicable to a display device in which each pixel employs a TFT, other than the TFT made from oxide semiconductor, such as a TFT made from a-Si or a TFT made from LTPS.

(Summary)

In order to attain the object of the present invention, a display device of the present invention is configured to include: a display panel which includes (i) a plurality of gate signal lines, (ii) a plurality of source signal lines provided so as to intersect the plurality of gate signal lines, and (iii) a plurality of pixels provided so as to correspond to respective intersections of the plurality of gate signal lines and the plurality of source signal lines; a signal line driving circuit for supplying a source signal to each of the plurality of pixels via a corresponding one of the plurality of source signal lines; refresh rate changing means for changing a refresh rate of the display panel; and polarity reversal controlling means for changing, in accordance with a change in the refresh rate, at least one of a temporal cycle and a spatial cycle of a polarity reversal of the source signal.

According to the display device, even in a case where a reduction in power consumption and a deterioration in display quality are caused by the change in refresh rate, the deterioration in the display quality can be suppressed by changing the temporal cycle or the spatial cycle. Furthermore, according to the display device, even in a case where an improvement in the display quality and an increase in the power consumption are caused by the change in refresh rate, the increase in the power consumption can be suppressed by changing the temporal cycle or the spatial cycle. Therefore, according to the display device, it is possible to reduce the power consumption and suppress the deterioration in the display quality.

It is preferable to configure the display device such that the polarity reversal controlling means shortens the spatial cycle, in a case where the refresh rate is decreased.

According to the configuration, even in a case where the display quality is deteriorated by such a decrease in refresh rate, such a deterioration can be suppressed by shortening the spatial cycle. It is therefore possible to reduce the power consumption and suppress the deterioration in the display quality.

It is preferable to configure the display device such that the polarity reversal controlling means lengthens the spatial cycle, in a case where the refresh rate is increased.

According to the configuration, even in a case where the power consumption is increased by such an increase in the refresh rate, such an increase in the power consumption can be suppressed by lengthening the spatial cycle. It is therefore possible to improve the display quality and suppress the increase in the power consumption.

It is preferable to configure the display device such that the polarity reversal controlling means shortens the temporal cycle, in a case where the refresh rate is decreased.

According to the configuration, even in a case where the display quality is deteriorated by such a decrease in the refresh rate, such a deterioration can be suppressed by shortening the temporal cycle. It is therefore possible to reduce the power consumption and suppress the deterioration in the display quality.

It is preferable to configure the display device such that the polarity reversal controlling means lengthens the temporal cycle, in a case where the refresh rate is increased.

According to the configuration, even in a case where the power consumption is increased by such an increase in the refresh rate, such an increase in the power consumption can be suppressed by lengthening the temporal cycle. It is therefore possible to improve the display quality and suppress the increase in the power consumption.

It is preferable to configure the display device such that the polarity reversal controlling means shortens at least one of the temporal cycle and the spatial cycle, in a case where the refresh rate becomes less than 35 Hz.

In the case where the refresh rate becomes less than 35 Hz, a display defect such as flicker is easily caused. According to the configuration, however, it is possible to change the temporal cycle and/or the spatial cycle at a more appropriate timing.

It is preferable to configure the display device such that the polarity reversal controlling means lengthens at least one of the temporal cycle and the spatial cycle, in a case where the refresh rate becomes more than 65 Hz.

In the case where the refresh rate becomes more than 65 Hz, the power consumption is easily increased. According to the configuration, however, it is possible to change the temporal cycle and/or the spatial cycle at a more appropriate timing.

It is preferable to configure the display device such that the polarity reversal controlling means gradually changes at least one of the temporal cycle and the spatial cycle.

According to the configuration, the temporal cycle or the spatial cycle is gradually changed. It is therefore possible to prevent a viewer from feeling odd while the temporal cycle or the spatial cycle is being changed.

It is preferable to configure the display device such that the polarity reversal controlling means gradually changes at least one of the temporal cycle and the spatial cycle every even-numbered frames.

According to the configuration, it is possible to write a positive source signal and a negative source signal in each of the plurality of pixels so that the number of the writing of the positive source signal in the each of the plurality of pixels is equal to the number of the writing of the negative source signal in the each of the plurality of pixels. It is therefore possible to eliminate a deviation in polarities of source signals to be written in the each of the pixels.

It is preferable to configure the display device such that a semiconductor layer of a TFT of each of the plurality of pixels is made of oxide semiconductor.

In a case where, in a display device, each pixel employs a TFT made from oxide semiconductor having excellent ON characteristic and OFF characteristic, a refresh rate can be easily changed. This heightens the necessity of reducing power consumption and/or suppressing a deterioration in display quality. Therefore, by applying the display device of the present invention to such a display device, it is possible to bring about a more effective effect.

It is preferable to configure the display device such that the oxide semiconductor is an IGZO (InGaZnOx).

In a case where, in a display device, a TFT of each pixel is made from an IGZO having more excellent ON characteristic and OFF characteristic, a refresh rate is more easily changed. This easily heightens the necessity of reducing power consumption and/or suppressing a deterioration in display quality. Therefore, by applying the display device of the present invention to such a display device, it is possible to bring about a more effective effect.

It is preferable to configure the display device such that the refresh rate changing means decreases the refresh rate of the display panel by securing a suspension time period during which driving of the display panel is being suspended.

According to the configuration, it is possible to reduce more power consumption, as compared with decreasing the refresh rate instead of securing any suspension time period.

INDUSTRIAL APPLICABILITY

A display device of the present invention is applicable to active matrix display devices, such as an active matrix liquid crystal display device, an active matrix organic EL display device, and an active matrix electronic paper.

REFERENCE SIGNS LIST

1: display device
2: display panel
4: scan line driving circuit
6: signal line driving circuit
8: common electrode driving circuit
10: timing controller
12: electric power generating circuit
15: refresh rate changing section (refresh rate changing means)
20: polarity reversal controlling section (polarity reversal controlling means)
30: system-side control section

The invention claimed is:

1. A display device, comprising:

a display panel which includes (i) a plurality of gate signal lines, (ii) a plurality of source signal lines provided so as to intersect the plurality of gate signal lines, and (iii) a plurality of pixels provided so as to correspond to respective intersections of the plurality of gate signal lines and the plurality of source signal lines;

a signal line driving circuit that supplies a source signal to each of the plurality of pixels via a corresponding one of the plurality of source signal lines; and a timing controller; wherein the timing controller changes a refresh rate of the display panel;

the timing controller changes at least one of a temporal cycle and a spatial cycle of a polarity reversal of the source signal in accordance with a change in the refresh rate;

the timing controller shortens the spatial cycle in a case where the refresh rate is decreased;

the timing controller lengthens the spatial cycle in a case where the refresh rate is increased; and the timing controller decreases the refresh rate of the display panel by securing a suspension time period, which directly corresponds to one or more frames of video, during which driving of the display panel is suspended.

2. The display device as set forth in claim 1, wherein:

the timing controller shortens the temporal cycle, in a case where the refresh rate is decreased.

3. The display device as set forth in claim 1, wherein:

the timing controller lengthens the temporal cycle, in a case where the refresh rate is increased.

4. The display device as set forth in claim 1, wherein:
the timing controller shortens at least one of the temporal cycle and the spatial cycle, in a case where the refresh rate becomes less than 35 Hz.

5. The display device as set forth in claim 1 wherein:
the timing controller lengthens at least one of the temporal cycle and the spatial cycle, in a case where the refresh rate becomes more than 65 Hz.

6. The display device as set forth in claim 1 wherein:
the timing controller gradually changes at least one of the temporal cycle and the spatial cycle.

7. The display device as set forth in claim 6, wherein:
the timing controller gradually changes at least one of the temporal cycle and the spatial cycle every even-numbered frame.

8. The display device as set forth in claim 1 wherein:
a semiconductor layer of a TFT of each of the plurality of pixels is made of oxide semiconductor.

9. The display device as set forth in claim 8, wherein:
the oxide semiconductor is an InGaZnOx.

* * * * *